US007461986B2

(12) United States Patent
Kawaguchi et al.

(10) Patent No.: US 7,461,986 B2
(45) **Date of Patent: *Dec. 9, 2008**

(54) WIRE DOT PRINTER

(75) Inventors: Takahiro Kawaguchi, Mishima (JP); Yasunobu Terao, Shizuoka (JP); Keishi Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 96 days.

This patent is subject to a terminal disclaimer.

(21) Appl. No.: 11/434,094

(22) Filed: May 15, 2006

(65) Prior Publication Data

US 2006/0204306 A1 Sep. 14, 2006

Related U.S. Application Data

(62) Division of application No. 10/940,361, filed on Sep. 14, 2004, now Pat. No. 7,048,455.

(30) Foreign Application Priority Data

Mar. 15, 2004 (JP) ..... 2004-072633

(51) Int. Cl.
*B41J 2/275* (2006.01)

(52) U.S. Cl. ..... 400/124.23; 400/124.22; 400/124.11

(58) Field of Classification Search ..... 400/124.23, 400/124.01, 124.07, 124.22, 124.11, 124.1, 400/124.2; 101/93.05
See application file for complete search history.

(56) References Cited

U.S. PATENT DOCUMENTS 4,252,449 A * 2/1981 Miyazawa et al. ..... 400/124.23
4,552,064 A 11/1985 Sanders, Jr. et al.
4,674,896 A 6/1987 Yasunaga et al.
4,697,939 A 10/1987 Ara
4,767,227 A * 8/1988 Mitsuishi et al. ..... 400/124.23
4,802,776 A 2/1989 Miyazawa et al.
4,838,714 A 6/1989 Beck et al.
4,881,832 A 11/1989 Mitsuishi et al.
4,976,554 A * 12/1990 Shimosato et al. ..... 400/124.21
4,988,223 A * 1/1991 Hilkenmeier et al. .. 400/124.23
4,993,854 A * 2/1991 Sato ..... 400/124.23
5,074,687 A 12/1991 Gugel et al.
5,137,377 A 8/1992 Ito et al.
5,205,659 A 4/1993 Gugel et al.
5,290,112 A * 3/1994 Stempfle et al. ..... 400/124.23
5,454,649 A 10/1995 Cattaneo (Continued)

FOREIGN PATENT DOCUMENTS

JP 02-011336 A 1/1990
JP 7-22994 B2 2/1990
JP 3-007351 A 1/1991
JP 3-39256 A 2/1991
JP 03-191036 A 8/1991

(Continued)

*Primary Examiner*—Leslie J. Evanisko
*Assistant Examiner*—Matthew G Marini
(74) *Attorney, Agent, or Firm*—Frishauf, Holtz, Goodman & Chick, P.C.

(57) ABSTRACT

In order to realize a stable rocking operation of the armature for performing high-speed printing, between the armature spacer for accommodating and holding the support shaft of the armature which supports the printing wires, and the yoke for holding the support shafts of the plurality of armatures together with this armature spacer, there is provided the abrasion preventing member formed of material having higher magnetic permeability than that of the yoke, and hardened by surface hardening processing.

16 Claims, 4 Drawing Sheets

U.S. PATENT DOCUMENTS

| | | | | |
|---|---|---|---|---|
| 5,527,118 | A * | 6/1996 | Asada et al. | 400/124.24 |
| 5,975,776 | A * | 11/1999 | Groenke | 400/124.21 |
| 6,513,997 | B2 | 2/2003 | Terao | |
| 6,698,956 | B1 * | 3/2004 | Terao et al. | 400/124.23 |
| 6,729,782 | B2 * | 5/2004 | Ichitani et al. | 400/124.22 |
| 6,776,545 | B1 * | 8/2004 | Terao | 400/124.23 |
| 6,805,503 | B1 * | 10/2004 | Tsuchiya et al. | 400/124.23 |
| 6,848,843 | B1 * | 2/2005 | Kawaguchi | 400/124.23 |
| 6,872,016 | B2 * | 3/2005 | Kawaguchi | 400/124.11 |
| 6,994,482 | B2 | 2/2006 | Terao et al. | |
| 7,048,455 | B2 * | 5/2006 | Kawaguchi et al. | 400/124.23 |
| 2004/0170461 | A1 | 9/2004 | Kawaguchi | |
| 2005/0053407 | A1 | 3/2005 | Kawaguchi | |
| 2005/0058488 | A1 | 3/2005 | Kawaguchi | |
| 2005/0160576 | A1 | 7/2005 | Kawaguchi | |
| 2005/0201797 | A1 | 9/2005 | Kawaguchi | |
| 2005/0201799 | A1 | 9/2005 | Tsuchiya et al. | |
| 2005/0201800 | A1 | 9/2005 | Tsuchiya | |
| 2005/0201801 | A1 | 9/2005 | Kawaguchi | |
| 2005/0207814 | A1 | 9/2005 | Kawaguchi | |
| 2005/0207815 | A1 | 9/2005 | Kawaguchi | |
| 2005/0214052 | A1 | 9/2005 | Kawaguchi | |
| 2008/0014004 | A1 | 1/2008 | Kawaguchi et al. | |

FOREIGN PATENT DOCUMENTS

| | | | |
|---|---|---|---|
| JP | 4-002639 | A | 1/1992 |
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-187972 | A | 7/1997 |
| JP | 09-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |
| JP | 3-288660 | A | 12/2001 |

* cited by examiner

WIRE DOT PRINTER

CROSS REFERENCE TO RELATED APPLICATION

This application is a Divisional Application of U.S. Ser. No. 10/940,361, now U.S. Pat. No. 7,048,455, filed Sep. 14, 2004, which is based on Japanese Priority Document P2004-72633 filed on Mar. 15, 2004, the content of which is incorporated herein by reference.

BACKGROUND OF THE INVENTION

1. Field of the Invention

The present invention relates to a wire dot printer head and a wire dot printer.

2. Discussion of the Background

The wire dot printer head is a device which, when the armature is rocked to a printing position by rocking an armature obtained by connecting printing wires between the printing position and a standby position, performs printing by causing a tip portion of the wire to collide with a printing medium such as a sheet.

Among such wire dot printer heads, there has been proposed a device which performs printing by generating magnetic flux around the armature targeted for rocking by coils to thereby form a magnetic circuit for attracting the armature from the standby position to the printing position (See Japanese Patent Laid-Open No. 4-105945). In a wire dot printer head of Patent Literature 1, the armature has a support shaft, and is provided in such a manner as to be freely pivotable with the support shaft as a center. Between the support shaft of the armature and a by-pass magnetic path provided on a yoke, for forming a magnetic circuit, there has been provided a sheet-shaped spacer formed of SK material. Thereby, the support shaft of the armature is prevented from wearing the surface of the by-pass magnetic path during a printing operation.

When, however, between the support shaft of the armature and the by-pass magnetic path, there is provided a spacer made of SK material as described in the Patent Literature 1, a magnetic characteristic in the magnetic circuit is deteriorated because the magnetic permeability of the spacer is lower than that of the by-pass magnetic path or the yoke. For this reason, any stable rocking operation of the armature cannot be realized, and in addition, the magnetic characteristic required for high-speed printing is not acquired. Consequently, high-speed printing cannot be performed. Particularly, as the printing speed in recent years becomes faster, it is required that the armature be rocked, for example, 2500 numbers of times/second between the printing position and the standby position. Therefore, deteriorated magnetic characteristic has become an important issue.

SUMMARY OF THE INVENTION

It is an object of the present invention to realize a stable rocking operation of the armature and to enable high-speed printing.

A wire dot printer head according to the present invention, comprising:

a plurality of printing wires;

a plurality of armatures for supporting the printing wires respectively and having support shafts which are centers of pivoting respectively;

a yoke having a plurality of cores around which coils have been wound respectively, and for holding the support shaft such that the armatures oppose to the cores respectively;

an armature spacer provided on the yoke, having a plurality of cutouts for accommodating the support shafts, and for holding the support shaft together with the yoke;

a hold-down member provided on the armature spacer, for holding down the support shaft; and an abrasion preventing member provided between the yoke and the armature spacer, for preventing the support shaft of the armature from coming into contact with the yoke, wherein the abrasion preventing member is formed of material having higher magnetic permeability than that of the yoke, and the surface thereof has been hardened so as to have higher surface hardness than that of the support shaft by hardening processing.

A wire dot printer according to the present invention, comprising:

a wire dot printer head, comprising:

a plurality of printing wires;

a plurality of armatures for supporting the printing wires respectively and having support shafts which are centers of pivoting respectively;

a yoke having a plurality of cores around which coils have been wound respectively, and for holding the support shaft such that the armatures oppose to the cores respectively;

an armature spacer provided on the yoke, having a plurality of cutouts for accommodating the support shafts, and for holding the support shaft together with the yoke;

a hold-down member provided on the armature spacer, for holding down the support shaft; and an abrasion preventing member provided between the yoke and the armature spacer, for preventing the support shaft of the armature from coming into contact with the yoke, wherein the abrasion preventing member is formed of material having higher magnetic permeability than that of the yoke, and the surface thereof has been hardened so as to have higher surface hardness than that of the support shaft by hardening processing;

a platen which opposes to the wire dot printer head;

a carriage for holding the wire dot printer head and reciprocating along the platen; and a printing medium conveying portion for conveying a printing medium between the wire dot printer head and the platen, wherein the wire dot printer executes printing based on printing data by drivingly controlling the wire dot printer head, the carriage, and the printing medium conveying portion.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

With reference to FIGS. 1 to 4, the description will be made of a best mode for carrying out the present invention.

<Wire Dot Printer Head>

First, with reference to FIGS. 1 to 3, the description will be made of overall structure of a wire dot printer head 1.

Figure 1:
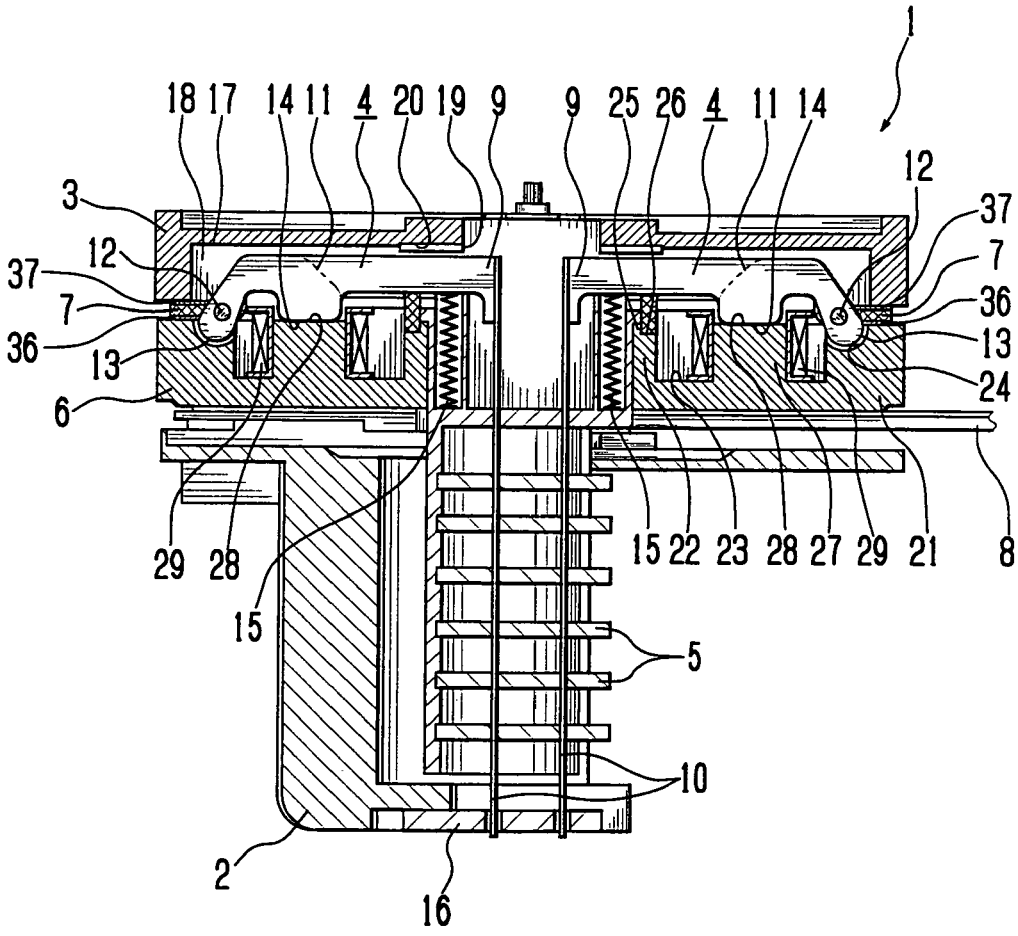
FIG. 1 is a central longitudinal front view schematically showing a wire dot printer head according to an embodiment of the present invention.
Figure 2:
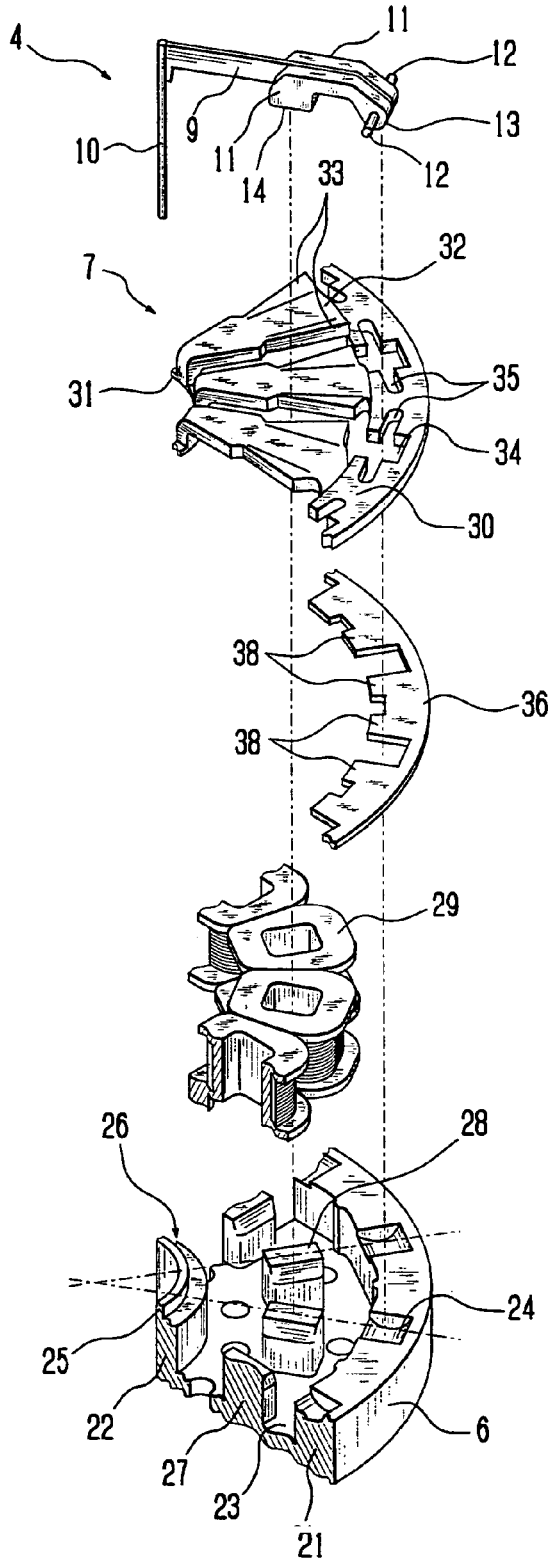
FIG. 2 is an exploded perspective view schematically showing a part of the wire dot printer head according to an embodiment of the present invention.
Figure 3:
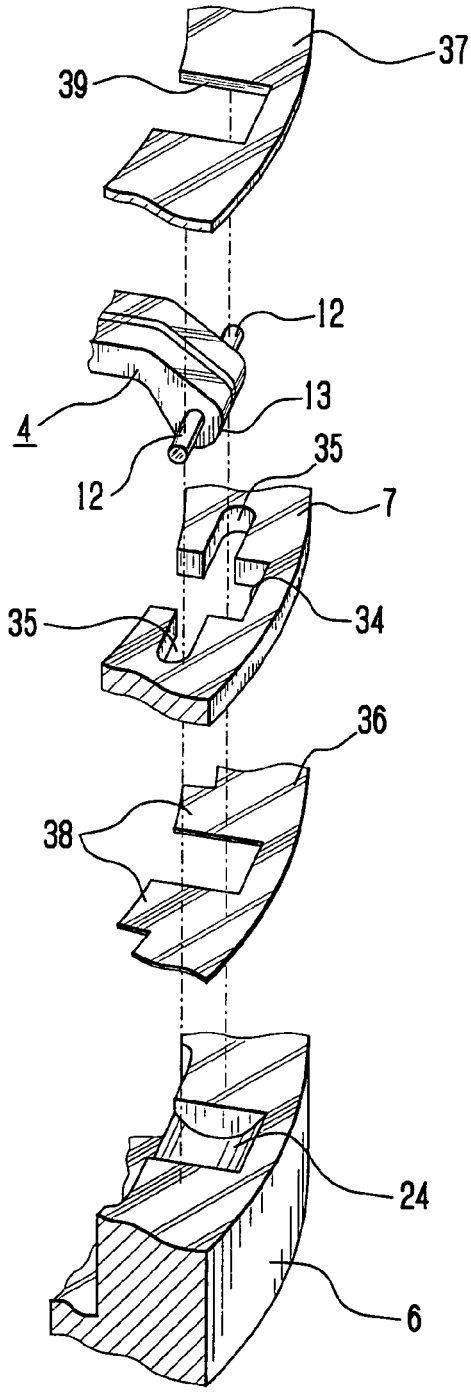
FIG. 3 is an exploded perspective view schematically showing a part of the wire dot printer head according to an embodiment of the present invention.

FIG. 1 is a central longitudinal front view schematically showing the wire dot printer head 1 according to the present embodiment, and FIGS. 2 and 3 are exploded perspective views schematically showing a part of the wire dot printer head 1.

The wire dot printer head 1 has a front case 2 and a rear case 3 which are to be coupled by means of fixing screws (not shown). Between the cases 2 and 3, there are provided an armature 4, a wire guide 5, a yoke 6, an armature spacer 7, a circuit substrate 8 and the like.

The armature 4 has: an arm 9 formed in a plate shape, for supporting a printing wire (hereinafter, referred to as wire simply) 10 at one end in a direction of length (direction in which the arm 9 extends); a magnetic circuit formation member 11 provided on both sides of the arm 9 in a widthwise direction for forming a magnetic circuit; and a support shaft 12 which serves as a center of pivoting (center of rocking). The wire 10 is brazed to one end of the arm 9. A circular arc-shaped portion 13 is formed at an end portion of the armature 4 on the other end side. The magnetic circuit formation member 11 is provided with an attracted surface 14, which is located in a central portion of the armature 4 in the longitudinal direction.

A plurality of such armatures 4 are arranged radially toward the shaft center of the yoke 6. Thus, the armatures 4 are supported on the surface of the yoke 6 respectively in a freely pivotable (rockable) state in a direction to separate from the yoke 6 with the support shaft 12 as a center, and are biased in the direction to separate from the yoke 6 by a biasing member 15 such as a coil spring. The biasing member 15 is provided to enable the biasing operation.

A wire guide 5 guides the wire 10 in such a manner as to be freely slidable such that the tip portion of the wire 10 collides with the printing medium at its predetermined position. Also, the front case 2 is provided with a tip guide 16 for causing tip portions of the wire 10 to stand in a row in accordance with a predetermined pattern and for guiding the wire 10 in such a manner as to be freely slidable. In this respect, when the armature 4 rocks to the printing position, along with the rocking operation of the armature 4, the tip portion thereof moves to a predetermined position, for example, a position where it collides with the printing medium such as a sheet.

The rear case 3 is provided with a cylindrical portion 18 having a base portion 17 on one end side. In the central portion of the base portion 17, there is formed a fitting concave portion 20 to which an annular armature stopper 19 made of metal is to be fitted. The armature stopper 19 is fitted by being fitted in the fitting concave portion 20. In this case, when the armature 4 rocks from the printing position by the biasing member 15, the arm 9, which is one portion of the armature 4, abuts against the armature stopper 19 to stop the rocking of the armature 4. Therefore, the armature stopper 19 has a function to determine the standby position of the armature 4.

The circuit substrate 8 has a driving circuit for controlling rocking of the armature 4 between the printing position and the standby position. The driving circuit of the circuit substrate 8 selects any armature 4 from among a plurality of armatures 4 to rock at the time of the printing operation.

The yoke 6 has a pair of cylindrical portions 21, 22 having different diameters provided concentrically. Dimensions of each of cylindrical portions 21, 22 in a direction of the shaft center (up-and-down direction of space in FIG. 1, that is, direction of shaft center of the yoke 6) have been set to be equal to each other. The cylindrical portion 21 on the outer peripheral side and the cylindrical portion 22 on the inner peripheral side have been made integral by a base portion 23 provided so as to block one end side in the direction of the shaft center. In this respect, the yoke 6 has been formed by a Lost Wax method or a MIM (Metal Injection Molding) method using, for example, PMD (Permendur) material, which is magnetic material excellent in magnetic characteristic, as the material. The surface hardness of the yoke 6 is about Hv 330. The surface of the yoke 6 has been polished to secure its flatness and surface roughness at the predetermined values. Such a yoke 6 is held between the front case 2 and the rear case 3 in a state in which an opened side, which is opposite to the base portion 23, is opposed to an opened side of the rear case 3.

The cylindrical portion 21 on the outer peripheral side is formed with a plurality of recesses 24 of the same number as the number of the armatures 4. These recesses 24 have a concave surface shape, the inner peripheral surface of which has been formed to the substantially same curvature radius as that of the outer peripheral surface of the circular-arc shaped portion 13 of the armature 4. In the recess 24, the circular-arc shaped portion 13 formed on one end side of the armature 4 has been fitted in such a manner as to be freely slidable.

The cylindrical portion 22 on the inner peripheral side is provided with a portion 25 to be fitted in, having an annular shape. The portion 25 to be fitted in is provided integrally with the cylindrical portion 22 on the inner peripheral side so as to be located concentrically to the cylindrical portion 22 on the inner peripheral side. The outer diameter of the portion 25 to be fitted in has been set to be smaller than the outer diameter of the cylindrical portion 22 on the inner peripheral side. Therefore, the cylindrical portion 22 on the inner peripheral side is formed with a stepped portion 26 by the portion 25 to be fitted in.

At the base portion 23, there are integrally provided a plurality of cores 27 arranged in an annular shape between the cylindrical portion 21 on the outer peripheral side and the cylindrical portion 22 on the inner peripheral side. The dimensions of each core 27 of the yoke 6 in the direction of shaft center have been set to be equal to those of the cylindrical portions 21, 22 of the yoke 6 in the direction of shaft center.

At one end of the yoke 6 in each core 27 in the direction of shaft center, magnetic pole surfaces 28 are formed respectively. The magnetic pole surface 28 of the core 27 has been provided so as to oppose to the attracted surface 14 of the magnetic circuit formation member 11 provided on the armature 4. Also, on the outer periphery of each core 27, coils 29 are fitted respectively. In other words, the yoke 6 has, in an annular shape, a plurality of cores 27 around which the coils 29 have been wound respectively. In this respect, in the present embodiment, directions of winding of all the coils 29 have been set to be equal to one another, but the present invention is not limited thereto, but for example, coils differentiated in direction of winding can be selectively arranged.

The armature spacer 7 has a pair of ring-shaped portions 30, 31 having substantially the same diameter as diameters of the cylindrical portions 21, 22 of the yoke 6, and a plurality of guide portions 32 radially laid over between the pair of ring-shaped portions 30, 31 so as to be located between the armatures 4. These guide portions 32 serve as by-pass magnetic paths for the armatures 4. The ring-shaped portion 30 on the outer peripheral side and the ring-shaped portion 31 on the inner peripheral side are concentrically provided. The ring-shaped portion 30 on the outer peripheral side, the ring-shaped portion 31 on the inner peripheral side and the guide portion 32 are integrally molded. Such an armature spacer 7 is formed of magnetic material.

When the armature spacer 7 is provided on the yoke 6, the ring-shaped portion 30 on the outer peripheral side and the ring-shaped portion 31 on the inner peripheral side abut against the cylindrical portions 21, 22 of the yoke 6 respectively, and the ring-shaped portion 31 on the inner peripheral side fits in the portion 25 to be fitted in. In this respect, the inner diameter of the ring-shaped portion 31 on the inner peripheral side has been set so as to be equal to or somewhat larger than the outer diameter of the portion 25 to be fitted in.

Each guide portion 32 has a side yoke portion 33 which extends in an oblique direction to separate from the magnetic pole surface 28 of the core 27 along a substantially radial direction of the ring-shaped portions 30, 31. This side yoke portion 33 is shaped like such a blade as to become larger in width toward the ring-shaped portion 30 on the outer peripheral side from the ring-shaped portion 31 on the inner peripheral side.

Since a plurality of guide portions 32 are laid over between the pair of ring-shaped portions 30, 31, the armature spacer 7 is provided with a slit-shaped guide groove 34 which is opened along a radial direction of the ring-shaped portions 30, 31. Each guide groove 34 is formed in such a width dimension as to come close to the magnetic circuit formation member 11 to such a degree that the side yoke portion 33 of the each guide portion 32 does not prevent the armature 4 from rocking.

Also, the guide groove 34 communicates to the ring-shaped portion 30 on the outer peripheral side, and the guide groove 34 in the ring-shaped portion 30 on the outer peripheral side is formed with a bearing groove 35, which is a cutout portion continuously opened in the guide groove 34 at positions on both sides of the guide groove 34 along a direction of the outer diameter of the ring-shaped portion 30. In this bearing groove 35, a support shaft 12 of the armature 4 is fitted. In other words, the support shaft 12 of the armature 4 is held by the yoke 6 and the armature spacer 7 such that the armature 4 opposes to the core 27.

Between the yoke 6 and the armature spacer 7, an abrasion preventing member 36 is provided. The abrasion preventing member is for preventing the support shafts 12 of the plurality of armatures 4 from coming into contact with the yoke 6. On the armature spacer 7, hold-down members 37 are provided. The hold-down members 37 are for holding down the support shafts 12 of the plurality of armatures 4.

The abrasion preventing member 36 is formed in an annular shape so as not to prevent the plurality of armatures 4 from rocking, and has a plurality of contact preventing portions 38. The plurality of contact preventing portions 38 are provided between the yoke 6 and the plurality of armatures 4 respectively. Also, in order to construct the magnetic path between the core 27 of the yoke 6 and the armature 4 in a minimum distance, the abrasion preventing member 36 is formed in the shape of a plate with thickness of, for example, about 0.20 mm and is provided on the yoke 6. Further, the abrasion preventing member 36 has higher magnetic permeability than that of the yoke 6, and higher surface hardness than that of the support shaft 12. Specifically, the abrasion preventing member 36 is formed of material having higher magnetic permeability than that of the yoke 6, for example, PMD material. Thus, the surface of the abrasion preventing member 36 has been subjected to hardening processing.

With this processing, the surface hardness of the abrasion preventing member 36 exceeds Hv450, and the abrasion preventing member 36 has durability that it will not be worn out by means of the support shaft 12 of the plurality of armatures 4. As the hardening processing, for example, nitriding processing has been used. In this respect, on the surface of the abrasion preventing member 36, the nitriding processing is performed, whereby there will be no need for performing corrosion prevention processing such as plating processing on the surface of the abrasion preventing member 36.

The hold-down member 37 is a plate-shaped member for holding down the support shaft 12 of the plurality of armatures 4 by coupling the front case 2 and the rear case 3 by fixing screws. This hold-down member 37 is formed in an annular shape so as not to prevent the armature 4 from rocking, having a plurality of groove portions 39. The plurality of groove portions 39 extend in the radial direction at substantially the same width dimension as the width dimension of the armature 4 respectively. Also, the hold-down member 37 has higher magnetic permeability than that of the yoke 6, and higher surface hardness than that of the support shaft 12. Specifically, the hold-down member 37 is formed of material having higher magnetic permeability than that of the yoke 6, for example, PMD material. Thus, the surface of the hold-down member 37 has been subjected to hardening processing. With this processing, the surface hardness of the hold-down member 37 exceeds Hv450, and the hold-down member 37 has durability that it will not worn out by means of the support shaft 12. As the hardening processing, for example, nitriding processing has been used. Also, on the surface of the hold-down member 37, the nitriding processing is performed, whereby there will be no need for performing corrosion prevention processing such as plating processing on the surface of the abrasion preventing member 36 because a nitriding layer is formed on the surface. In this respect, in the present embodiment, although the hold-down member 37 has been formed of the PMD material, the present invention is not limited thereto, but it may be formed of, for example, the SK material hardened by the surface hardening processing.

In this case, the diameter of the support shaft 12 of the armature 4 is about 0.90 mm, and the thickness of the armature spacer 7 in a portion for constituting the bearing groove 35 is about 0.80 mm. Therefore, when the support shaft 12 of the armature 4 is fitted in the bearing groove 35, the support shaft 12 protrudes from the bearing groove 35 by about 0.10 mm to abut against the hold-down member 37. Consequently, it can be reliably held.

<Wire Dot Printer>

Figure 4:
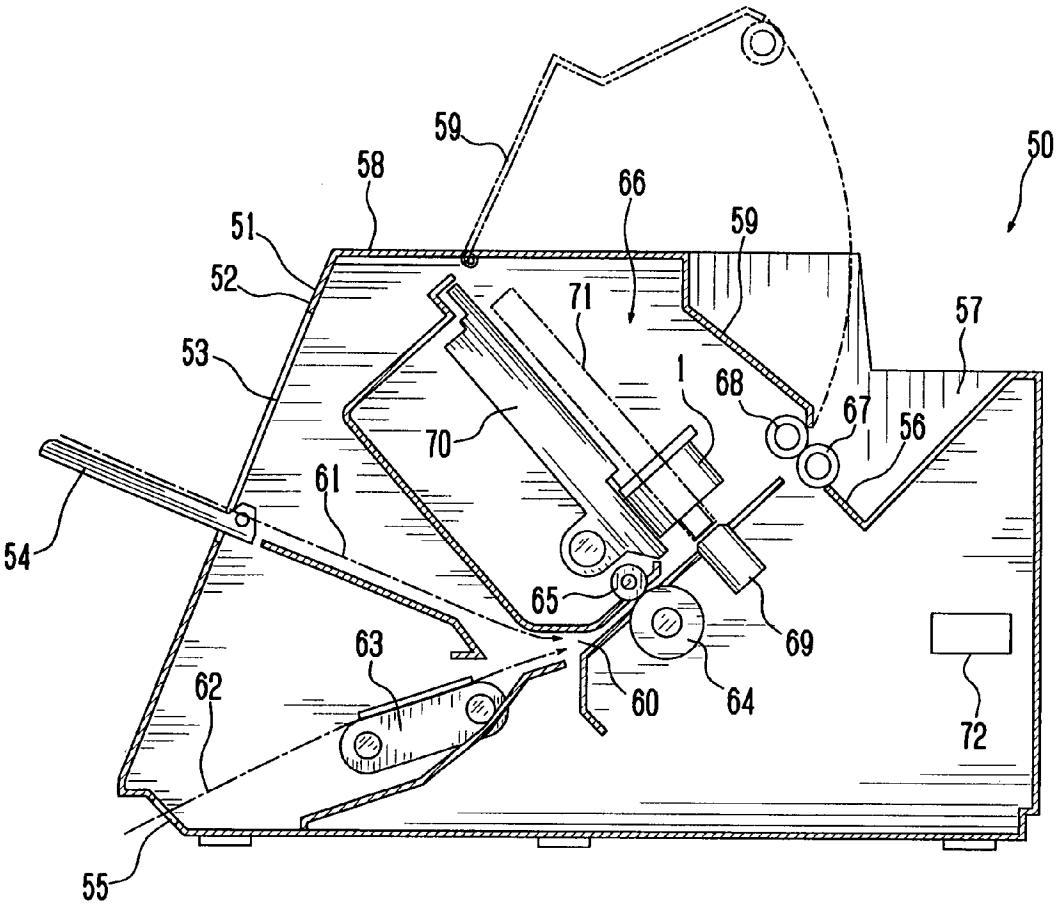
FIG. 4 is a longitudinal side view schematically showing a wire dot printer according to an embodiment of the present invention.

Next, with reference to FIG. 4, the description will be made of a wire dot printer 50 equipped with such a wire dot printer head 1 as described above. FIG. 4 is a longitudinal side view schematically showing a wire dot printer 50 according to the present embodiment.

The wire dot printer 50 has a main body case 51. On the front surface 52 of this main body case 51, an aperture 53 is formed. The aperture 53 is provided with a manual tray 54 in such a manner as to be freely opened and closed. Also, on the lower part of the main body case 51 on the front surface 52 side, a paper feeding port 55 is formed, and on the rear surface 56 side, an exhaust sheet receiver 57 is provided. Further, on the upper surface 58 of the main body case 51, an open-close cover 59 is pivotally provided. In this case, the open-close cover 59 in an opened state is indicated by a virtual line in FIG. 4.

Within the main body case 51, there is provided a sheet conveying course 60, which is a printing medium conveying course. The upstream side of this sheet conveying course 60 in a sheet conveying direction is connected to a sheet feeding passage 61 arranged on an extending surface of the manual sheet tray 54 in an opened state, and to a sheet feeding passage 62 leading to the sheet feeding port 55, and the downstream side in the sheet conveying direction is connected to the exhaust sheet receiver 57. In the sheet feeding passage 62, a tractor 63 for conveying sheets is provided.

In the sheet conveying course 60, a conveying roller 64 and a hold-down roller 65 are arranged to oppose each other, and the hold-down roller 65 is pressed against the conveying roller 64. These conveying roller 64 and hold-down roller 65 convey a sheet, which is a printing medium, and constitute a sheet conveying portion, which is a printing medium conveying portion. Further, the sheet conveying course 60 is provided with a printer portion 66 for performing a printing operation on a sheet to be conveyed, and at the inlet of the exhaust sheet receiver 57, an exhaust sheet roller 67 is provided. A hold-down roller 68 pressed against this exhaust sheet roller 67 is pivotally supported on a free end side of the open-close cover 59.

The printer portion 66 is composed of: a platen 69 arranged in the sheet conveying course 60; a carriage 70 capable of freely reciprocating in a direction orthogonal to the sheet conveying course 60 along this platen 69; a wire dot printer head 1 and an ink ribbon cassette 71 such as the ones which have been mounted on the carriage 70 as described above; and the like. In this respect, the ink ribbon cassette 71 is detachably provided.

The carriage 70 is driven by a motor (not shown) to reciprocate along the platen 69. The wire dot printer head 1 reciprocates in a main scanning direction as the carriage 70 reciprocates along the platen 69. For this reason, in the present embodiment, a head driving mechanism is realized by the carriage 70, the motor and the like. Also, the wire dot printer 50 incorporates a drivingly control portion 72 for controlling each portion within the main body case 51, and this drivingly control portion 72 drivingly controls each portion such as the printer portion 66, the tractor 63 and the motor.

In such structure, when cutform is used as a sheet, it is fed from the manual sheet tray 54, and when a continuous sheet is used as a sheet, it is fed from the sheet feeding port 55. Either sheet (not shown) is conveyed by the conveying roller 64, is printed by the wire dot printer head 1, and is discharged onto the exhaust sheet receiver 57 by the exhaust sheet roller 67.

Printing is performed in the wire dot printer head 1 as described below. By selectively exciting coils 29, the armature 4 is attracted to the magnetic pole surface 28 of the core 27 to pivot with the support shaft 12 as a center, and the wire 10 is pressed against a sheet on the platen 69 via an ink ribbon (not shown) to thereby perform printing. When electrical energization to the coil 29 is cut off, the armature 4 returns by a biasing force of a biasing member 15 to stop at the standby position by an armature stopper 19. In this case, a sheet has been used as a printing medium, but the present invention is not limited thereto. For example, it is also possible to use a pressure sensitive color development sheet, the pressurized portion of which develops color by being pressurized. When the pressure sensitive color development sheet is used as a printing medium, a portion, which has been pressurized by pressure of the wire 10 provided in the wire dot printer head 1, develops color, whereby printing is performed.

At the time of a printing operation by the wire dot printer 50, electrical energization to the coils 29 is selectively performed on the basis of the printing data under the control of the drivingly control portion 72. Then, there is formed a magnetic circuit reaching from the core 27 to which the selected coil 29 has been mounted, to the core 27 again via the magnetic circuit formation member 11 of the armature 4 arranged in opposition to this core 27, a pair of side yoke portions 33 opposite to this magnetic circuit formation member 11, the guide portion 32, the cylindrical portion 21 on the outer peripheral side and the cylindrical portion 22 on the inner peripheral side of the yoke 6, and the base portion 23.

The formation of this magnetic circuit causes an attraction force for attracting the magnetic circuit formation member 11 to the magnetic pole surface 28 of the core 27 between the attracted surface 14 of the magnetic circuit formation member 11 and the magnetic pole surface 28 of the core 27. This attraction force rocks the armature 4 with the support shaft 12 as a center in a direction that the attracted surface 14 of the magnetic circuit formation member 11 is attracted to the magnetic pole surface 28 of the core 27. In this respect, in the present embodiment, a position where the attracted surface 14 of the magnetic circuit formation member 11 of the armature 4 abuts against the magnetic pole surface 28 of the core 27 is set to the printing position.

The armature 4 rocks to the printing position, whereby the tip portion of the wire 10 protrudes on the sheet side. At this time, since an ink ribbon is interposed between the wire dot printer head 1 and the sheet, the pressure of the wire 10 is transmitted to the sheet via the ink ribbon, and the ink of the ink ribbon is transferred onto the sheet to thereby perform printing.

When electrical energization to the coil 29 is cut off, the magnetic flux that has been generated disappears, and therefore, the magnetic circuit also disappears. Thereby, the attraction force for attracting the magnetic circuit formation member 11 to the magnetic pole surface 28 of the core 27 is lost. The armature 4 is biased by a biasing force of the biasing member 15 in a direction to separate from the yoke 6 to rock toward the standby position with the support shaft 12 as the center. In other words, the armature 4 rocks toward the standby position, and the arm 9 abuts against the armature stopper 19 to thereby stop at the standby position.

Such a printing operation is performed at high speed (for example, printing speed=2500 number of times/second) At this time, the armature 4 is to rock between the printing position and the standby position at, for example, 2500 number times/second. Between the yoke 6 and the support shafts 12 of the plurality of armatures 4, there is provided the abrasion preventing member 36 formed of material having higher magnetic permeability than that of the yoke 6, and hardened by nitriding processing so as to have higher surface hardness than that of the support shaft 12, whereby the support shaft 12 does not come into direct contact with the yoke 6, and in addition, deteriorated magnetic characteristic caused by the provision of the abrasion preventing member 36 is prevented. Therefore, it is possible to realize a stable rocking operation of the armature for high-speed printing. Also, the abrasion preventing member 36 is provided on the yoke 6, whereby it becomes possible to form a magnetic circuit in a short distance for high-speed printing.

In this respect, in the present embodiment, since the hold-down members 37 has been formed of material having higher magnetic permeability than that of the yoke 6 as in the case of the abrasion preventing member 36, and the surface thereof has been hardened by hardening processing so as to have higher surface hardness than that of the support shaft 12, the magnetic characteristic in the magnetic circuit can be improved as compared with a case where only the abrasion preventing member 36 has been formed as described above.

Also, in the present embodiment, since the surface hardness of the abrasion preventing member 36 and that of the hold-down members 37 become higher because the hardening processing is nitriding processing, the abrasion preventing member 36 and the hold-down members 37 will not be worn out by the support shaft 12, and will not become rusty. Therefore, there will be no need for performing any corrosion prevention processing such as plating processing on the surface of the abrasion preventing member 36 and the surface of the hold-down members 37.

Also, the wire dot printer 50 according to the present embodiment has: a wire dot printer head 1 such as the one described above; a platen 69 opposite to the wire dot printer head 1; a carriage 70 for holding the wire dot printer head 1 and reciprocating along the platen 69; and a conveying roller 64 and a hold-down roller 65, which are a printing medium conveying portion for conveying the printing medium between the wire dot printer head 1 and the platen 69, and executes printing based on the printing data by drivingly controlling the wire dot printer head 1, the carriage 70, the conveying roller 64, and the hold-down roller 65. Therefore, it is possible to realize a stable rocking operation of the armature 4 for high-speed printing.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

a plurality of printing wires;

a plurality of armatures for supporting the printing wires, respectively, at respective first ends of the armatures;

a yoke having a base, a cylindrical portion provided on an outer peripheral side of the base, an annular interior on an interior side of the cylindrical portion, and a plurality of cores which are arranged in the annular interior and around which coils have been wound, respectively;

a holding mechanism for holding respective second ends of the armatures on the cylindrical portion of the yoke such that the armatures are swingable at positions opposite to the cores, respectively; and an abrasion preventing member provided on the cylindrical portion to prevent the armature from coming into direct contact with the yoke, wherein the abrasion preventing member is formed of a material having a magnetic permeability that is higher than a magnetic permeability of the yoke, and wherein a surface of the abrasion preventing member has been hardened by a hardening processing so as to have a higher surface hardness than a surface hardness of a portion of each of the second ends of the armatures that comes into contact with the surface of the abrasion preventing member.

2. The wire dot printer head according to claim 1, wherein the hardening processing is nitriding processing.

3. The wire dot printer head according to claim 1, wherein the holding mechanism comprises a hold-down member which holds down the armatures.

4. The wire dot printer head according to claim 3, wherein the hold-down member is formed of a material having a magnetic permeability that is higher than the magnetic permeability of the yoke, and wherein a surface of the hold-down member has been hardened by a hardening processing so as to have a higher surface hardness than a surface hardness of a portion of each of the second ends of the armatures that comes into contact with the surface of the hold-down member.

5. The wire dot printer head according to claim 4, wherein the hardening processing is nitriding processing.

6. The wire dot printer head according to claim 4, wherein the surface hardness of the hold-down member is greater than Hv450.

7. The wire dot printer head according to claim 6, wherein the surface hardness of the abrasion preventing member is greater than Hv450.

8. The wire dot printer head according to claim 1, wherein the surface hardness of the abrasion preventing member is greater than Hv450.

9. A wire dot printer head, comprising:

a plurality of printing wires;

a plurality of armatures for supporting the printing wires, respectively, at respective first ends of the armatures, each of the armatures having a support shaft at a second end thereof and being pivotable about the support shaft;

a yoke having a base, a cylindrical portion provided on an outer peripheral side of the base, an annular interior on an interior side of the cylindrical portion, and a plurality of cores which are arranged in the annular interior and around which coils have been wound, respectively;

a holding mechanism for holding the respective support shafts of the armatures on the cylindrical portion of the yoke such that the armatures are swingable at positions opposite to the cores, respectively; and an abrasion preventing member provided on the cylindrical portion to prevent support shafts of the armatures from coming into direct contact with the yoke, wherein the abrasion preventing member is formed of a material having a magnetic permeability that is higher than a magnetic permeability of the yoke, and wherein a surface of the abrasion preventing member has been hardened by a hardening processing so as to have a higher surface hardness than a surface hardness of the support shafts of the armatures.

10. The wire dot printer head according to claim 9, wherein the hardening processing is nitriding processing.

11. The wire dot printer head according to claim 9, wherein the holding mechanism comprises a hold-down member which holds down the support shafts of the armatures.

12. The wire dot printer head according to claim 11, wherein the hold-down member is formed of a material having a magnetic permeability that is higher than the magnetic permeability of the yoke, and wherein a surface of the hold-down member has been hardened by a hardening processing so as to have a higher surface hardness than the surface hardness of the support shafts of the armatures.

13. The wire dot printer head according to claim 12, wherein the hardening processing is nitriding processing.

14. The wire dot printer head according to claim 12, wherein the surface hardness of the hold-down member is greater than Hv450.

15. The wire dot printer head according to claim 14, wherein the surface hardness of the abrasion preventing member is greater than Hv450.

16. The wire dot printer head according to claim 9, wherein the surface hardness of the abrasion preventing member is greater than Hv450.

* * * * *